US006386846B1

(12) United States Patent
Murase et al.

(10) Patent No.: US 6,386,846 B1
(45) Date of Patent: May 14, 2002

(54) COMPRESSOR HAVING CONCENTRICALLY WALLED DAMPER

(75) Inventors: Masakazu Murase; Toshihiro Kawai; Yoshinobu Ishigaki; Shiro Hayashi, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/570,901

(22) Filed: May 15, 2000

(30) Foreign Application Priority Data

May 26, 1999 (JP) ..... 11-146843

(51) Int. Cl.[7] ..... F04B 11/00
(52) U.S. Cl. ..... 417/540; 181/403; 417/222.2
(58) Field of Search ..... 417/222.2, 312, 417/540; 181/403

(56) References Cited

U.S. PATENT DOCUMENTS

| | | | | |
|---|---|---|---|---|
| 3,612,216 A | | 10/1971 | Rieder | 181/53 |
| 3,804,125 A | * | 4/1974 | Sonneman | 138/30 |
| 4,234,427 A | * | 11/1980 | Boehme | 210/198 |
| 4,913,597 A | | 4/1990 | Christianson et al. | 406/39 |
| 4,930,995 A | | 6/1990 | Suzuki et al. | 417/312 |
| 5,133,647 A | * | 7/1992 | Herron et al. | 417/312 |
| 5,556,260 A | * | 9/1996 | Takenaka et al. | 417/269 |
| 5,674,054 A | | 10/1997 | Ota et al. | 417/269 |
| 5,703,336 A | * | 12/1997 | Tark et al. | 181/179 |
| 6,086,336 A | * | 7/2000 | Welschf et al. | 417/308 |
| 6,123,525 A | * | 9/2000 | Burns | 417/540 |
| 6,148,782 A | | 11/2000 | Fuesser | 123/184.53 |
| 6,149,397 A | * | 11/2000 | Mizutani et al. | 417/222.2 |
| 6,149,402 A | * | 11/2000 | Kim | 417/312 |
| 6,164,929 A | * | 12/2000 | Kazuya et al. | 417/362 |

FOREIGN PATENT DOCUMENTS

| | | |
|---|---|---|
| DE | 43 42 299 A1 | 1/1995 |
| DE | 196 22 235 A1 | 12/1997 |
| JP | A-7-139463 | 5/1995 |
| JP | A-10-141229 | 5/1998 |

OTHER PUBLICATIONS 00 11 0477 Search Report dated Mar. 19, 2001.

* cited by examiner

*Primary Examiner*—Michael Koczo
*Assistant Examiner*—William H Rodriguez
(74) *Attorney, Agent, or Firm*—Woodcock Washburn LLP

(57) ABSTRACT

A damping device is arranged in a gas passage in a compressor for damping compression waves transmitted from suction valves. The damping device includes a damper arranged in a damper hole provided in a pipe fitting of the compressor housing. The damper has concentric inner and outer cylindrical walls, and end wall closing ends of the inner and outer cylindrical walls, and radial holes at the end of the inner cylindrical wall. The outer cylindrical wall is arranged in the damper hole and the inner cylindrical wall is fitted in the fitting hole leading to the suction chamber. A gas passage is formed by an inner passage portion, radial holes, an inter-wall passage portion, a radial passage portion at the end opposite to radial holes, and an outer passage portion between the outer cylindrical wall and the side cylindrical wall of the damper hole.

11 Claims, 5 Drawing Sheets

COMPRESSOR HAVING CONCENTRICALLY WALLED DAMPER

BACKGROUND OF THE INVENTION

1. Field of the Invention

The present invention relates to a damping device arranged in a gas passage for damping compression waves transmitted from a vibration source by a gas in the gas passage, and a suction structure of a compressor having such a damping device incorporated wherein.

2. Description of the Related Art

Conventionally, a compressor of this type is coupled to an external coolant circuit to constitute a refrigerating circuit, and the suction chamber in the compressor is connected to an evaporator arranged on the downstream region of the external coolant circuit through a pipe. In the housing of the compressor, the suction chamber communicates with each cylinder bore through a suction port, and a suction valve (reed valve) is arranged at a position facing the suction port. The suction valve is arranged to come into contact with a retaining portion recessed in the surrounding wall of the cylinder bore.

In the case where the stroke of the piston is greater and the amount of the sucked gas is greater, the suction valve comes into contact with the retaining portion when the piston moves from the top dead center toward the bottom dead center. In the case where the stroke of the piston is smaller and the amount of the sucked gas is smaller, on the other hand, the suction valve does not sufficiently open to come into contact with the retaining portion when the piston moves from the top dead center toward the bottom dead center, and is subjected to self-excited vibration in an unstable floated state. The self-excited vibration of the suction valve generates compression waves, which are propagated to the evaporator as suction pulsations through a pipe from the suction chamber in the refrigerant gas as a medium.

As a result, the evaporator is vibrated by the suction pulsations propagated from the compressor through the pipe. The evaporator is located in the immediate vicinity of the air outlet of the air-conditioner of the automotive cabin, and therefore a large evaporator vibration causes noise.

SUMMARY OF THE INVENTION

The present invention has been developed in view of the aforementioned problem, and the object of the present invention is to provide a damping device and a suction structure of a compressor capable of reducing the propagation of the pulsations by damping compression waves propagated from a vibration source in the gas passage, and thus being capable of improving the damping efficiency.

The present invention provides a damping device arranged in a gas passage for damping compression waves transmitted from a vibration source by a gas in the gas passage. The damping device comprises at least one passage component, which comprises a first cylindrical wall defining a first passage portion therein, a second cylindrical wall arranged outside and parallel to the first cylindrical wall, the first and second cylindrical walls defining a second passage portion between them, a closure wall closing one end of the second passage portion, and a third passage portion arranged near the closure wall and connecting the first passage portion to the second passage portion. One of the first and second passage portions is located on the upstream side of the other of the first and second passage portions with respect to the transmitting direction of compression waves from the vibration source, and a cross-sectional area of the other passage portion is greater than a cross-sectional area of the one passage portion.

According to this configuration, in the damping device arranged in the gas passage, the cross-sectional area of the passage portions increases progressively toward the downstream side of transmission of the compression waves from the vibration source, and therefore a muffler effect is realized to thereby reduce the strength of the compression waves propagated from the vibration source. Also, in view of the fact that the second passage portion between the first and second cylindrical walls communicates with the first passage portion through the third passage portion in the vicinity of the closure wall, a path is formed with foldbacks changing the gas flow direction. As a result, the compression waves are scattered by impinging against the wall in the bent portions of the gas passage, and thus are further damped.

Preferably, the at least one passage component comprises two passage components, one of the two passage components comprising the first cylindrical wall, the second cylindrical wall, the closure wall, and the third passage portion, the other of the two passage components comprising the first cylindrical wall, the second cylindrical wall, the closure wall, and the third passage portion, and the second cylindrical wall of the one passage component and the first cylindrical wall of the other passage component being a common cylindrical wall, the closure wall of the one passage component being arranged at one end of the common cylindrical wall, the closure wall of the other passage component being arranged at the opposite end of the common cylindrical wall.

Preferably, the at least one passage component comprises two or more passage components, which are constituted by three or more concentric cylindrical walls, the closure wall of one of the passage components being arranged at one end of the intermediate cylindrical wall, the closure wall of another passage component being arranged at the opposite end of the intermediate cylindrical wall.

With this configuration, the passage components of the gas passage are coupled in such a manner as to form a route with direction changes, thereby increasing the numbers of direction changes and increasing the whole length of the gas passage. Thus, the effect of damping the compression waves is further improved. Therefore, it is possible to reduce the noise which is transmitted to the other location by the gas passage.

The present invention further provides a compressor having a damping device having a similar feature to that described above. That is, the compressor comprises a housing having at least one compression chamber, a suction chamber, and a discharge chamber, a compression mechanism including a drive shaft and members movable with the drive shaft to cause a gas to be sucked from the suction chamber, compressed in the compression chamber, and discharged into the discharge chamber, a valve device arranged between the suction chamber and the compression chambers, a gas passage connected to the suction chamber, and a damping device arranged in the gas passage for damping compression waves transmitted from a vibration source by a gas in the gas passage. The damping device has a construction similar to that of the above described damping device.

With this configuration, the compression waves generated by vibration sources in the compressor such as suction valves is damped, and the noise transmitted to another location, such as an evaporator of a refrigerating circuit, can be reduced.

Preferably, the damping device is incorporated in the housing of the compressor. Therefore, a compact compressor can be obtained.

Preferably, the housing of the compressor has a damper hole having a side cylindrical wall and a bottom wall, the bottom wall having a fitting hole extending to the suction chamber; the damping device comprising a damper arranged in the damper hole, the damper having an inner cylindrical wall, an outer cylindrical wall arranged outside and parallel to the inner cylindrical wall, an end wall, and at least one radial hole arranged through the inner cylindrical wall near the end wall; the inner cylindrical wall being fitted in the fitting hole for fluid communication with the suction chamber, the outer cylindrical wall being arranged in the damper hole and having one end attached to the end wall and the opposite end spaced apart from the bottom wall; the at least one passage component comprising two passage components, one of the two passage components comprising the inner cylindrical wall acting as the first cylindrical wall, the outer cylindrical wall acting as the second cylindrical wall, the end wall acting as the closure wall, and the at least one radial hole acting as the third passage portion; the other of the two passage components comprising the outer cylindrical wall acting as the first cylindrical wall, the side cylindrical wall acting as the second cylindrical wall, the bottom wall acting as the closure wall, and a space between the opposite end of the outer cylindrical wall and the bottom wall acting as the third passage portion; and the second cylindrical wall of the one passage component and the first cylindrical wall of the other passage component being a common cylindrical wall, the closure wall of the one passage component being arranged at one end of the common cylindrical wall, the closure wall of the other passage component being arranged at the opposite end of the common cylindrical wall.

In this way, the damping device can be constituted in part by the damper, and in part by the walls of the damper hole. Therefore, the damper can be made simple in construction, and the damping device as a whole can establish a higher damping effect.

Preferably, the suction chamber is arranged in the housing at a central region thereof, and the discharge chamber is arranged in the housing at a peripheral region thereof about the suction chamber, the inner cylindrical wall extending through the discharge chamber and reaching the suction chamber. The compressor has a plurality of compression chambers, and the inner cylindrical wall has an inner end located at the center of the suction chamber. Therefore, the gas can be smoothly and uniformly sucked into the respective compression chambers.

According to this configuration, the compression waves propagated to the evaporator are damped and, therefore, the vibration of the evaporator is reduced.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Embodiments of the present invention applied to a variable capacity type compressor used in a cooling system of an automotive vehicle or the like will be explained with reference to FIGS. 1 to 6, by way of an example.

Figure 1:
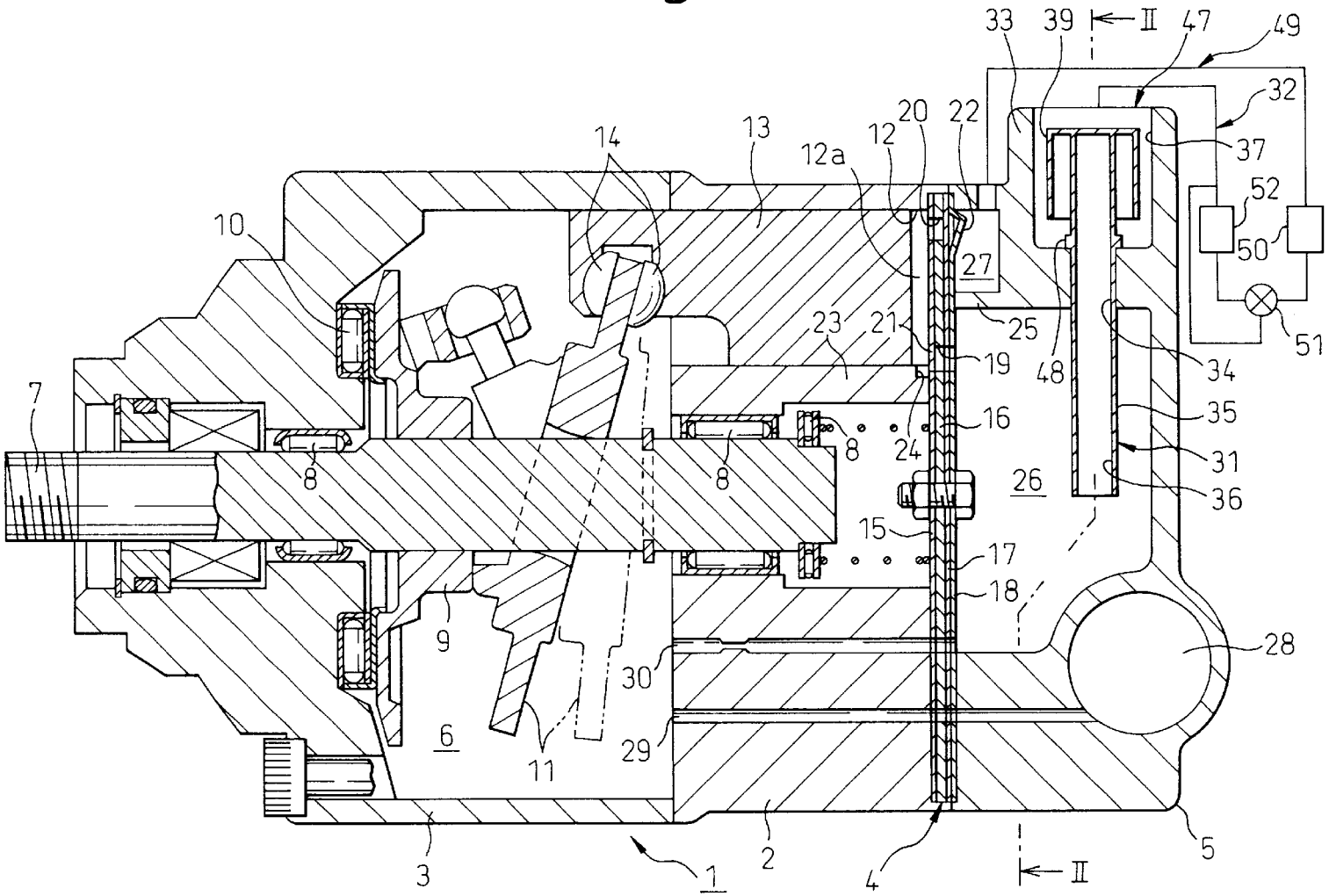
FIG. 1 is a side cross-sectional view of a compressor including a damping device according to the embodiment of the present invention.

As shown in FIG. 1, a compressor 1 according to the embodiment includes a cylinder block 2, a front housing 3 coupled to the front end of the cylinder block 2, and a rear housing 5 coupled to the rear end of the cylinder block 2 via a valve-forming member 4. A rotary shaft 7 extends through a crank chamber 6 formed by and between the front housing 3 and the cylinder block 2 and is rotatably supported by bearings 8. The front end (the left end portion in FIG. 1) of the rotary shaft 7 is operatively coupled to an external drive source (not shown) such as an engine through a clutch (not shown), for example.

A rotary support member 9 is fixed to the rotary shaft 7 and rotates with the rotary shaft 7 with a bearing 10 arranged in the inner surface of the front housing 3. A swash plate 11 is fitted on and supported by the rotary shaft 7 so that it can rotate with the rotary shaft 7 and tilt with respect to the rotary shaft 7.

The cylinder block 2 has a plurality of cylinder bores 12 arranged therethrough at circumferentially equidistant positions. The single-headed pistons 13 are arranged in the cylinder bores 12 and are coupled at the proximal ends thereof to the swash plate 11 through shoes 14, so the rotational motion of the swash plate 11 is converted to the reciprocal motion of the pistons 13. The regions defined by the cylinder bores 12 and the pistons 13 form compression chambers 12*a*.

Figure 2:
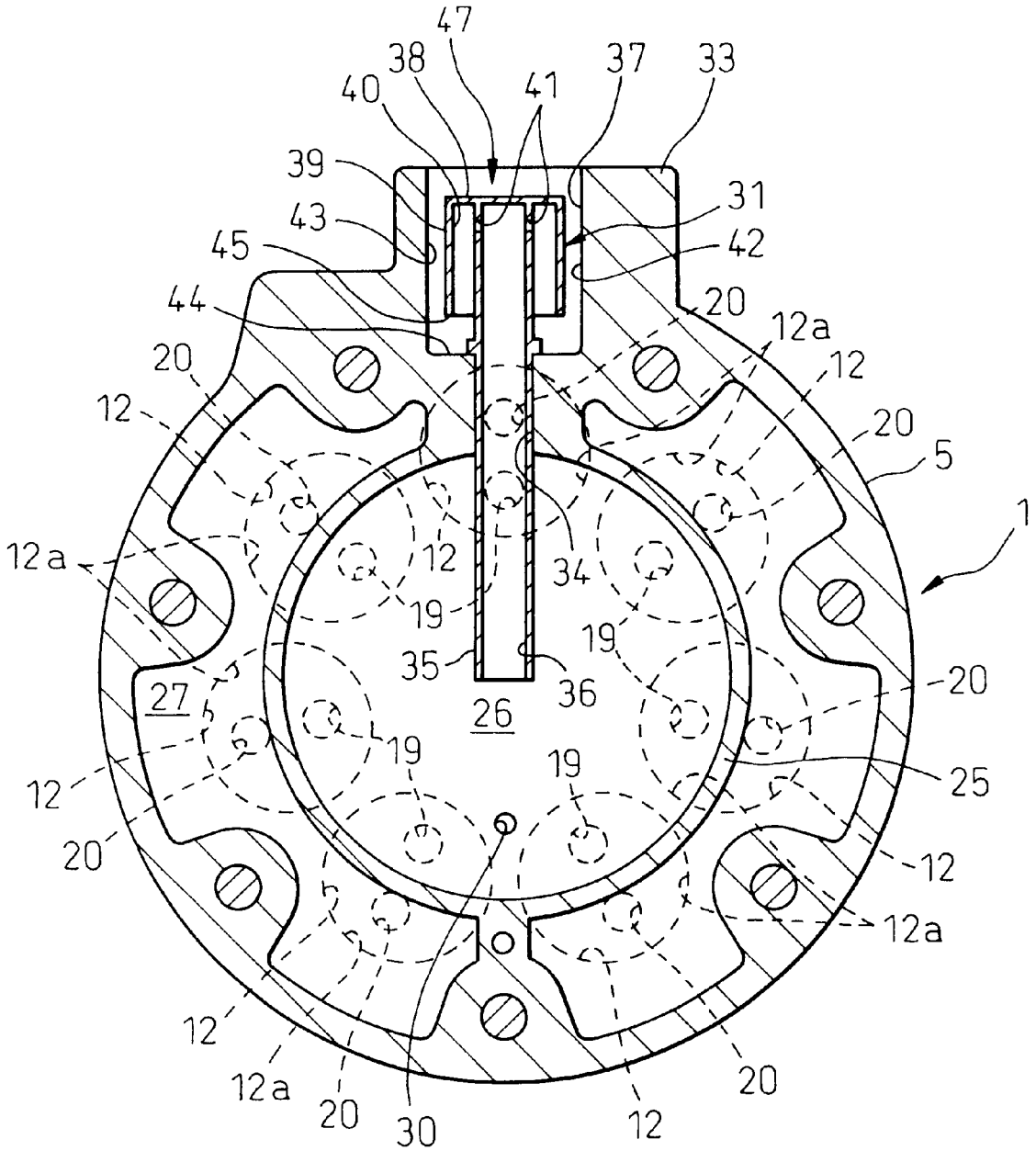
FIG. 2 is a cross-sectional view of the compressor, taken in line II—II in FIG. 1.

The valve-forming member 4 comprises a suction valve plate 15, a valve plate 16, a discharge valve plate 17, and a retainer plate 18. The valve plate 16 has suction ports 19 formed therethrough at radially inner positions and discharge ports 20 formed therethrough at radially outer positions, corresponding to the cylinder bores 12. As shown in FIG. 2, the suction ports 19 and the discharge ports 20 are arranged equidistantly on the respective circles centered at the axis of the rear housing 5. The suction valve plate 15 has suction valves 21 at positions corresponding to the suction ports 19, and the discharge valve 17 has discharge valves 22 at positions corresponding to the discharge ports 20.

As shown in FIGS. 1 and 2, an annular separating wall 25 is formed in the rear housing 5, so that a suction chamber 26 is defined on the inner peripheral side of the annular separating wall 25 and a discharge chamber 27 is defined on the outer peripheral side of the annular separating wall 25. The suction chamber 26 communicates with the cylinder bores 12 through the suction ports 19 and the suction valves 21, while the discharge chamber 27 communicates with the cylinder bores 12 through the discharge valves 22 and the discharge ports 20.

Figure 3:
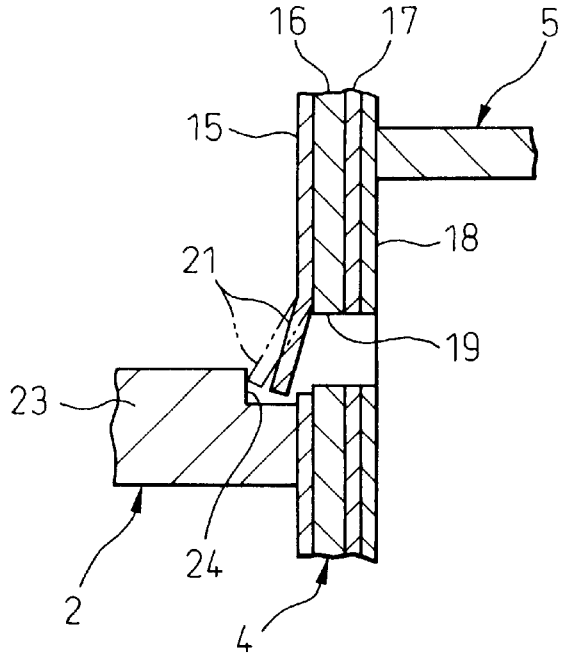
FIG. 3 is an enlarged cross-sectional view of a portion of the compressor, showing the suction valve in open state.

As shown in FIGS. 1 and 3, the inner wall 23 of the cylinder bore 12 has a retaining portion 24 recessed therein for restricting the opening of the suction valve 21. As shown in FIG. 3, the opening of the suction valve 21 assumes a maximum value (indicated by the dotted line) when the suction valve 21 comes into contact with the retaining portion 24. In the case where the stroke of the piston 13 is smaller and the amount of the sucked gas is smaller, the suction valve 21 does not sufficiently open to reach the retaining portion 24 and is subjected to self-excited vibration in an unstable floating state. In other words, the suction valve 21 constitutes a vibration source generating compression waves by the self-excited vibration thereof.

As shown in FIG. 1, a control valve 28 is arranged in the rear housing 5. The control valve 28 is interposed in a pressure bleed passage 29 connecting the crank chamber 6 to the discharge chamber 27. Also, the crank chamber 6 is connected to the suction chamber 26 through a pressure release passage (restricted passage) 30. The discharge capacity of the variable capacity type swash plate compressor 1 is controlled by adjusting the opening of the control valve 28 to thereby control the pressure in the crank chamber 6 (crank pressure) and thus to adjust the inclination angle of the swash plate 11. If the crank pressure is controlled to a higher level, the inclination angle of the swash plate 11 is decreased, so that the stroke of the pistons 13 is decreased, resulting in a reduced discharge capacity. If the crank pressure is controlled to a lower side, on the other hand, the inclination angle of the swash plate 11 is increased so that the stroke of the pistons 13 is increased, resulting in an increased discharge capacity.

As shown in FIGS. 1 and 2, a damper 31 is incorporated in the rear housing 5. The rear housing 5 has a pipe fitting 33 for connecting a suction pipe 32 (shown in FIG. 1) described later. The pipe fitting 33 has a damper hole 37 having a side cylindrical wall 42 and a bottom wall 44. The bottom wall 44 of the pipe fitting 33 has an insertion hole (fitting hole) 34 for communicating with the suction chamber 26. The damper 31 is mounted to the rear housing 5 by press-fitting an inner cylindrical wall 35 in the insertion hole 34 of the rear housing 5. The inner end of the inner cylindrical wall 35 extends to the vicinity of the axis of the compressor 1 (center of the suction chamber 26), so that the sucked coolant gas is led to the center of the suction chamber 26 by the inner cylindrical wall 35. The inner cylindrical wall 35 forms, therein, an inner passage portion 36 extending along the axis thereof (along the main gas flow direction) in the inner cylindrical wall 35.

Figure 4:
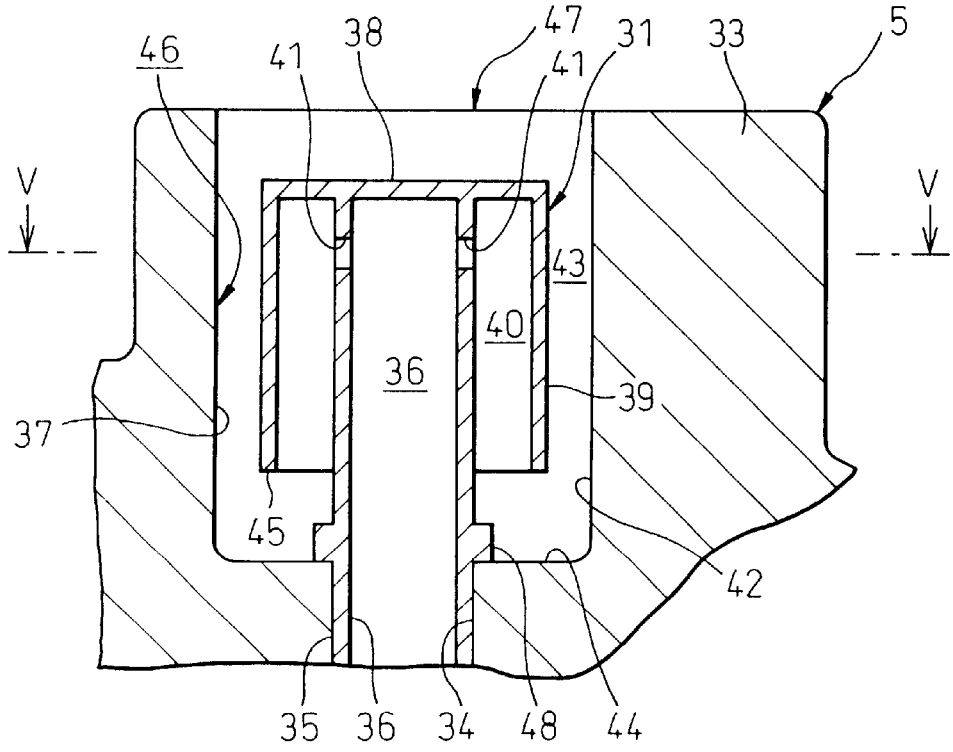
FIG. 4 is an enlarged cross-sectional view of a portion of the damping device.
Figure 5:
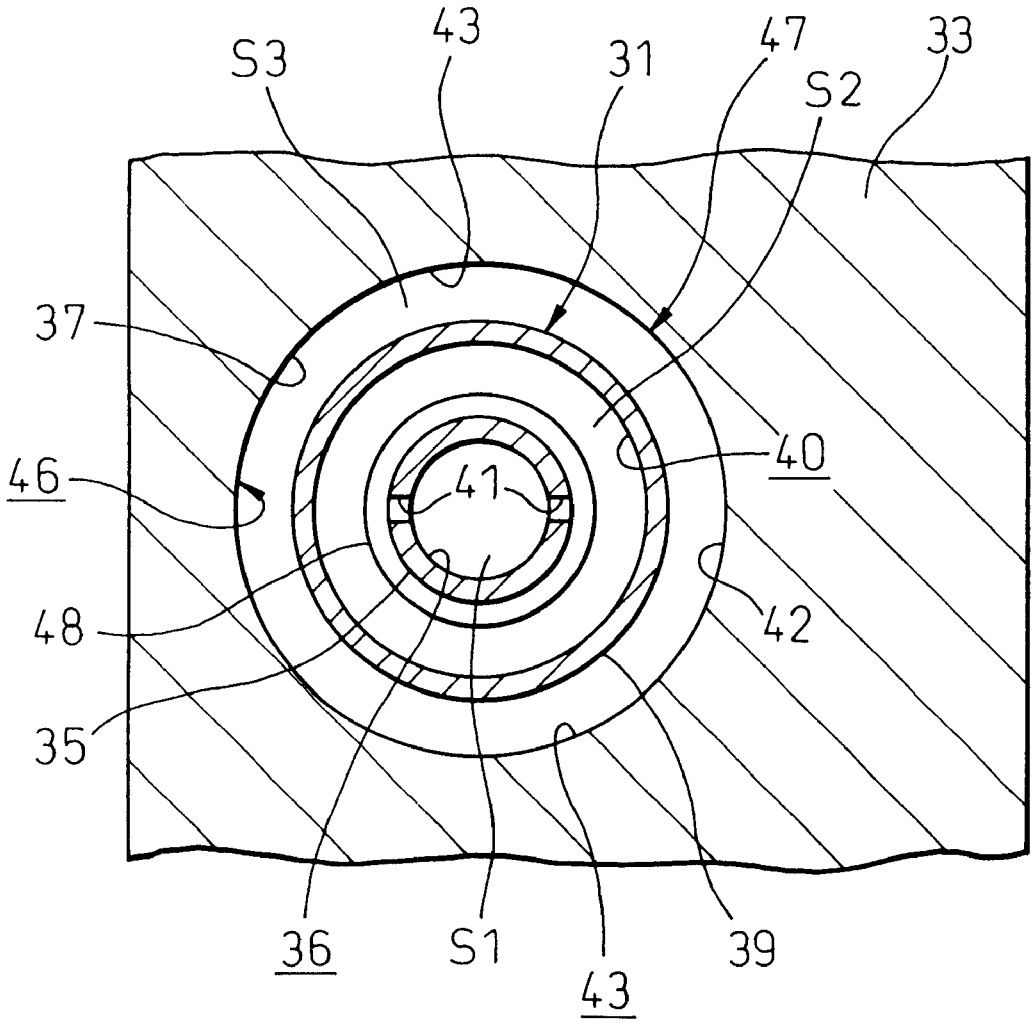
FIG. 5 is a cross-sectional view of the damper device, taken in line V—V in FIG. 4.

As shown in FIGS. 4 and 5, the inner cylindrical wall 35 has an outer end located in the damper hole 37 of the pipe fitting 33, and a closure wall 38 is formed integrally therewith in such a manner as to close the end of the inner passage portion 36. The closure wall 38 is shaped like a disk coaxial with the inner cylindrical wall 35 and has a diameter larger than the outer diameter of the inner cylindrical wall 35.

An outer cylindrical wall 39 is arranged outside and concentrically with the inner cylindrical wall 35 and is supported by the lower surface of the closure wall 38 at the outer peripheral region thereof. The outer cylindrical wall 39 is arranged to cover the outer portion of the inner cylindrical wall 35, and a cylindrical inter-wall passage portion 40 is defined between the outer and inner cylindrical walls 39 and 35.

Two radial communication holes 41 are formed in and through the inner cylindrical wall 35 in the vicinity of the closure wall 38, and the inner passage portion is connected to the inter-wall passage portion 40 through the radial communication holes 41. The side cylindrical wall 42 of the damper hole 37 is concentric with the inner and outer cylindrical walls 35 and 39, and an outer passage portion 43 is defined between the inner cylindrical wall 42 and the outer cylindrical wall 39. The inter-wall passage portion (intermediate passage portion) 40 communicates with the outer passage portion 43 through a radial communication passage portion 45 formed between the forward end (lower end) of the outer cylindrical wall 39 and the bottom wall 44 of the damper hole 37 (space between the walls 39 and 44). In this way, a damping device 47 having a gas passage path 46 including the inner passage portion 36, the radial communication holes 41, the inter-wall passage portion 40, the radial communication passage portion 45 and the outer passage portion 43 is constructed by arranging the damper 31 in the pipe fitting 33 of the rear housing 5. The gas passage 46 concentrically extends from the inner periphery toward the outer periphery along the main gas flow direction in two turns.

The damping device 47 has passage components. Specifically, in this embodiment, one passage component comprises the inner cylindrical wall 35, the closure wall 38, the outer cylindrical wall 39 and the radial communication holes 41, and another passage component comprises the outer cylindrical wall 39, the side cylindrical wall 42, the bottom wall 44 of the damper hole 37 and the radial communication passage 45. The radial communication holes 41 and the radial communication passage 45 of the two passage components of the gas passage 46 are arranged at the two end areas of the inter-wall passage portion 40 in a spaced-apart relationship with each other. By the way, in the latter passage component of the gas passage 46, the bottom wall 44 of the hole 37 corresponds to the closure wall.

The damper 31 has a stopper 48 formed on the outer surface of the inner cylindrical wall 35 and is assembled in the hole 37 in position with the stopper 48 in contact with the bottom wall 44. With the damper 31 set in position this way, the whole damper 31 is accommodated in the rear housing 5 and the forward end of the inner cylindrical wall 35 is located at the center of the suction chamber 26.

As shown in FIG. 5, if S1 is the cross-sectional area of the inner passage portion 36, taken perpendicular to the axis thereof, S2 is the cross-sectional area of the inter-wall passage portion 40, and S3 is the cross-sectional area of the outer passage portion 43, the relation holds that $S1<S2<S3$.

As shown in FIG. 1, a refrigerant circuit 49 in which the refrigerant gas flows includes a condenser 50, an expansion valve 51 and an evaporator 52. The pipe 32 connected to the evaporator 52 is connected to the pipe fitting 33 of the rear housing 5 of the compressor 1. By the way, the gas passage in which the damping device 47 is arranged is configured with the pipe 32, the outer passage portion 43, the radial communication passage portion 45, the inter-wall passage portion 40, the radial communication hole (passage portion) 41 and the inner passage portion 36.

The operation of the suction structure of the compressor having the damping device 47 will be now explained.

When the control valve 28 is controlled in such a manner as to reduce the discharge capacity, the crank pressure is increased and the stroke of the pistons 13 is reduced. Then, as shown in FIG. 3, when the piston 13 is moved rearward (leftward in FIG. 1), the suction valve 21 does not sufficiently open to contact the retaining portion 24 and is subjected to self-excited vibration in an unstable floated state (indicated by solid line). The self-excited vibration of the suction valve 21 generates compression waves in the refrigerant gas, and the compression waves propagate toward the evaporator 52 as a suction pulsations with the refrigerant gas acting as a transmitting medium.

As shown in FIG. 5, the compression waves propagate through the inner passage portion 36 having the cross-sectional area S1, turn at the radial communication holes 41, propagate through the inter-wall passage portion 40 having the cross-sectional area S2, turn at the radial communication passage portion 45, and then propagate through the outer passage portion 43 having the cross-sectional area S3. The gas passage 46 formed by assembling the damper 31 has such a structure that the cross-sectional areas S1, S2 and S3 progressively increase in this order, and therefore the compression waves are damped by the muffler effect when passing through the gas passage 46.

Also, the compression waves propagate through the inner passage portion 36, the radial communication holes 41, the inter-wall passage portion 40, the radial communication passage portion 45 and the outer passage portion 43 in this order while turning and the compression waves impinge against the wall surfaces and are scattered each time its direction of propagation is changed. Specifically, the suction pulsations due to the compression waves is further damped by a total of four direction changes while passing through the gas passage 46. Also, the gas passage 46 is comparatively long although it is arranged in the limited space in the hole 37 of the pipe fitting 33, and therefore the length of transmission distance also damps the suction pulsations (compression waves).

Figure 6:
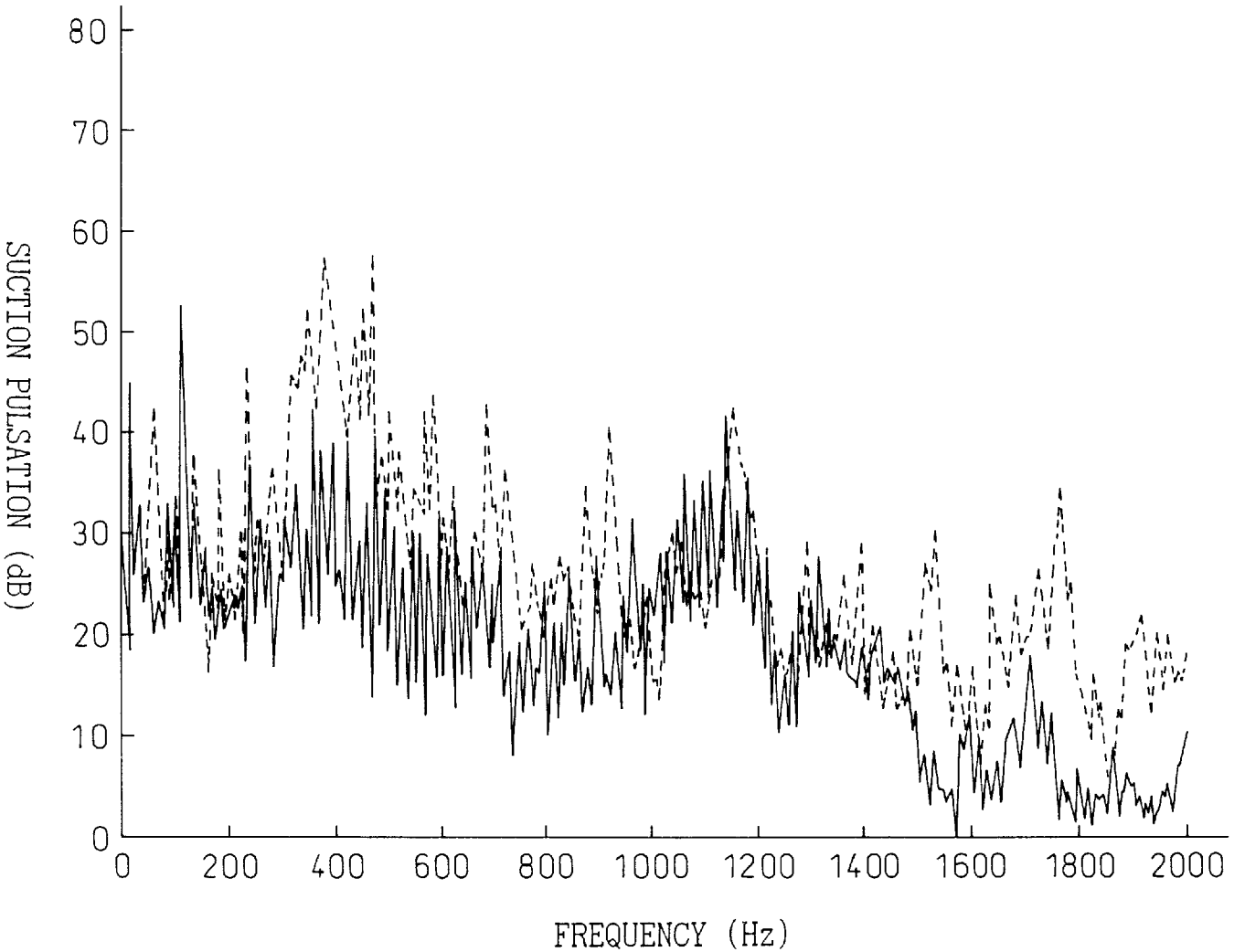
FIG. 6 is a graph showing the effect of reducing the suction pulsation.

The effect of reducing the suction pulsations is shown in FIG. 6. The ordinate represents the strength of the suction pulsations of the damping device 47 at the evaporator 52, and the abscissa represents the frequency of the suction pulsations. The dotted line indicates the waveform in the absence of the damping device 47, and the solid line indicates the waveform in the presence of the damping device 47. Especially, in the suction pulsation frequencies of 200 to 900 Hz and 1300 to 1900 Hz, the peak values of the suction pulsations are reduced, indicating the effect of reducing the suction pulsations. In an automotive vehicle, the sound having the frequency of 300 to 500 Hz often constitutes noise. Installing the damping device 47 on the compressor 1, however, reduces the sound at a frequency felt as a noise.

Thus, this embodiment can produce the following effects.

(1) The gas passage 46 of the damping device 47 configured by assembling the damper 31 in the rear housing 5 has such a structure that the cross-sectional area, taken perpendicular to the axis thereof, increases progressively toward the evaporator 52 and, therefore, the suction pulsations due to the compression waves can be damped by the muffler effect. Thus, the vibration of the evaporator 52 due to the suction pulsations can be reduced and the generation of noises can be reduced. Also, the gas passage 46, which has a concentric multilayered structure having repeated foldbacks along the main gas flow direction from the inner periphery toward the outer periphery, can be configured in a compact form, while at the same time, making it possible to produce a large damping efficiency in the limited space.

(2) The gas passage 46 has a bent structure, and the compression waves are scattered as they impinge against the walls at each bent portion of the gas passage 46, and therefore the scattering can further damp the suction pulsations due to the compression waves.

(3) The radial passage portions 41 and 45 are located at the ends in spaced apart relation from each other, so that the length of the gas passage 46 can be increased while the damping device 47 is compact. Therefore, the length of the gas passage increases the effect of reducing the pulsation, thus further reducing the noises from the evaporator 52.

(4) Since the forward end of the inner cylindrical wall 35 is located at the center of the suction chamber 26, the distances between the forward end thereof and the respective suction ports 19 are uniform, and therefore the coolant gas can be smoothly sucked in. Also, the provision of the stopper 48 on the outer surface of the inner cylindrical wall 35 makes it possible to position the forward end of the damper 31 at the center of the suction chamber 26 when the whole damper 31 is accommodated in the rear housing 5 in the process of assembling the damper 31 on the compressor 1.

By the way, the present invention is not limited to the described embodiments, but can be modified in the following way, for example.

The number of the passage components of the gas passage is not limited to two, but may be 1, for example. Also, three or more passage components can be provided. However, if the gas passage 46 is too narrow, the pressure loss may increase when the gas is sucked. The number of the passage components of the gas passage should be determined by taking the pressure loss of suction into account.

The damper 31 is not limited to the structure in which it is assembled in the rear housing 5, but the damping device 47 can alternatively be arranged midway in the pipe 32 between the evaporator 52 and the rear housing 5.

The inner cylindrical wall 35 and the outer cylindrical wall 39 are not limited to a circular cylindrical shape. It may, alternatively, be a polygonal cylinder, for example.

The damping device 47 is not limited to the structure in which the side cylindrical wall 42 and the bottom wall 44 of the rear housing 5 are used for forming the gas passage 46. In the damper 31 shown in FIG. 4 or 5, for example, an extension having the shape of a substantially bottomed cylinder is formed to extend in such a manner as to cover the outer cylindrical wall 39 along the bottom wall 44 and the side cylindrical wall 42 from vicinity of the stopper 48. In this case, the damper 31 itself can independently constitute a damping apparatus.

The application of the damping device 47 and the suction structure of the compressor thereof according to the embodiment are not limited to the variable capacity type compressor 1. Specifically, the damping device and the suction structure of the compressor according to the invention can be employed for any compressor other than a variable capacity type compressor.

The application of the damping device 47 is not limited to the reduction of the pulsations of the compressor. Specifically, it can be employed for other devices (equipment) for reducing the compression waves from a vibration source.

As described in detail above, according to the present invention, the compression waves generated from a vibration source can be damped with a high damping efficiency by installing the damping device in the gas passage. Also, the compression waves (suction pulsations) generated from a vibration source in the compressor can be efficiently damped midway in the propagation path and thus the generation of noise and foreign sounds can be reduced.

What is claim is:

1. A damping device arranged in a gas passage for damping compression waves transmitted from a vibration source by a gas in the gas passage, said damping device comprising at least one passage component, said passage component comprising:

a first cylindrical wall defining a first passage portion therein;

a second cylindrical wall arranged outside and parallel to said first cylindrical wall, said first and second cylindrical walls defining a second passage portion between them;

a closure wall closing one end of said first passage portion and a corresponding end of said second passage portion; and a third passage portion arranged near said closure wall and connecting said first passage portion to said second passage portion;

wherein said first passage portion is located on the upstream side of said second passage portion with respect to the transmitting direction of compression waves from said vibration source, and a cross-sectional area of said second passage portion is greater than a cross-sectional area of said first passage portion.

2. A damping device according to claim 1, wherein said at least one passage component comprises two passage components, a first passage component comprising said first cylindrical wall, said second cylindrical wall, said closure wall, and said third passage portion; and a second passage component comprising said second cylindrical wall, a third cylindrical wall outside of said second cylindrical wall, a bottom wall arranged opposite said closure wall, and a communication passage portion disposed between said bottom wall and said second cylindrical wall.

3. A damping device according to claim 1, wherein said at least one passage component comprises two or more passage components, which are constituted by three or more concentric cylindrical walls, said closure wall of one of the passage components being arranged at one end of an intermediate cylindrical wall, and a closure wall of another passage component being arranged at the opposite end of said intermediate cylindrical wall.

4. A compressor comprising:

a housing having at least one compression chamber, a suction chamber, and a discharge chamber;

a compression mechanism including a drive shaft and members movable with said drive shaft to cause a gas to be sucked from said suction chamber, compressed in said compression chamber, and discharged into said discharge chamber;

a valve device arranged between said suction chamber and said compression chamber;

a gas passage connected to said suction chamber; and a damping device arranged in said gas passage for damping compression waves transmitted from a vibration source by a gas in the gas passage, said damping device comprising at least one passage component, said passage component comprising:

a first cylindrical wall defining a first passage portion therein;

a second cylindrical wall arranged outside and parallel to said first cylindrical wall, said first and second cylindrical walls defining a second passage portion between them;

a closure wall closing one end of said first passage portion and a corresponding end of said second passage portion; and a third passage portion arranged near said closure wall and connecting said first passage portion to said second passage portion;

wherein said first passage portion is located on the upstream side of said second passage portion with respect to the transmitting direction of compression waves from said vibration source, and a cross-sectional area of said second passage portion is greater than a cross-sectional area of said first passage portion.

5. A compressor according to claim 4, wherein said damping device is incorporated in the housing of the compressor.

6. A compressor according to claim 5, wherein said housing of the compressor has a damper hole having a side cylindrical wall and a bottom wall, said bottom wall having a fitting hole extending to said suction chamber;

said damping device comprising a damper arranged in said damper hole and fitted in said fitting hole for fluid communication with said suction chamber;

said at least one passage component comprising two passage components, a first passage component comprising said first cylindrical wall, said second cylindrical wall, said closure wall, and said third passage portion; and a second passage component comprising said second cylindrical wall, said side cylindrical wall, said bottom wall, and a communication passage between said bottom wall and said second cylindrical wall.

7. A compressor according to claim 6, wherein said suction chamber is arranged in said housing at a central region thereof, and said discharge chamber is arranged in said housing at a peripheral region thereof about said suction chamber, said first cylindrical wall extending through said discharge chamber and reaching said suction chamber.

8. A compressor according to claim 7, wherein said compressor has a plurality of compression chambers, and said first cylindrical wall has an inner end located at the center of the suction chamber.

9. A compressor according to claim 7, wherein said first cylindrical wall has a stopper which abuts against the bottom wall of the damper hole when said first cylindrical wall is fitted in said fitting hole.

10. A compressor according to claim 4, wherein said valve device has suction valves, and said vibration source comprises said suction valves.

11. A compressor according to claim 4, wherein said gas passage has one end connected to said suction chamber and the other end connected to an evaporator.

* * * * *